United States Patent [19]

Sausner et al.

[11] Patent Number: 4,702,209

[45] Date of Patent: Oct. 27, 1987

[54] DEVICE FOR ADJUSTING THE IDLING RPM

[75] Inventors: Andreas Sausner; Peter Volz, both of Frankfurt am Main, Fed. Rep. of Germany

[73] Assignee: VDO Adolf Schindling AG, Frankfurt am Main, Fed. Rep. of Germany

[21] Appl. No.: 781,450

[22] Filed: Sep. 27, 1985

[30] Foreign Application Priority Data

Sep. 28, 1984 [DE] Fed. Rep. of Germany ..... 3435701

[51] Int. Cl.[4] ..... F02M 23/04

[52] U.S. Cl. ..... 123/339; 123/585; 251/282

[58] Field of Search ..... 123/339, 585; 261/41 D, 261/42, DIG. 74; 137/505.13; 251/129.07, 282

[56] References Cited

U.S. PATENT DOCUMENTS 3,949,964 4/1976 Freeman ..... 251/129.07
3,970,282 7/1976 Hansen ..... 251/129.07
4,421,083 12/1983 Stoltman ..... 123/339
4,438,049 3/1984 Ammons ..... 123/339 X
4,475,518 10/1984 Kashiwaya et al. ..... 123/339 X
4,476,828 10/1984 Kobayashi et al. ..... 123/339
4,627,596 12/1986 Busacchi ..... 251/282

FOREIGN PATENT DOCUMENTS 3113986 10/1982 Fed. Rep. of Germany .

*Primary Examiner*—Willis R. Wolfe, Jr.

[57] ABSTRACT

The valve member (4) of a bypass valve (2) of a device for regulating the idling of an internal combustion engine is provided, for pressure equalization, with a back-pressure chamber (8) which is in communication via a pressure-equalization connection (9) with the pressure-inlet side of the bypass valve (2). This pressure-equalization connection (9) debouches as close as possible to the narrowest point of the gap between the valve member (4) and the valve seat (7) in the housing (1) of the bypass valve (2).

4 Claims, 2 Drawing Figures

DEVICE FOR ADJUSTING THE IDLING RPM

FIELD AND BACKGROUND OF THE INVENTION

The present invention relates to a device for regulating the idling rpm of an internal combustion engine having an intake pipe with a throttle valve disposed therein, which valve can be actuated as desired. Around the throttle valve extends a bypass having a bypass valve which can be controlled as a function of operating parameters of the internal combustion engine, said bypass valve having a valve element which is displaceable relative to a valve seat by an electromagnet so as to regulate the size of a passage cross section, said valve element having a pressure-equalization surface in a back-pressure chamber from which a pressure-equalization connection leads to the intake side of the valve element.

Devices of this type serve to keep the content of noxious substances in the exhaust gases of internal combustion engines low and to decrease the fuel consumption. They are at present finding wider and wider use. As example of the state of the art, mention may be made of Federal Republic of Germany OS 31 13 986. In both of them it is specifically stated that the valve element is to be pressure equalized. This is also to be definitely striven for so that a valve positioning element can be displaced with as little force as possible and remains by itself in the position in which it is. In accordance with Federal Republic of Germany OS 30 10 167, the pressure-equalization connection is a borehole which extends through the valve element. In Federal Republic of Germany OS 31 13 986 it is a conduit which debouches between the bypass valve and the intake pipe into a line leading to the bypass valve.

It has been found that the force which moves the valve element in its opening direction is dependent not only on the pressure difference but also on the position of the valve element. This is due in particular to the conditions of flow in the bypass valve, which change with the position of the valve element. Therefore in the known devices only incomplete pressure equalization of the valve element of the bypass valve is possible.

SUMMARY OF THE INVENTION

The object of the present invention is to develop a device of the aforementioned type for regulating the idling rpm which permits as complete as possible pressure equalization in any position of the valve element and which therefore can be displaced and held in its instantaneous position with as little force as possible.

This object is achieved in accordance with the invention by providing that the pressure-equalization connection starts as close as possible to the narrowest part of a gap between valve element and valve seat.

By this development of the device, which is no more expensive, or only insignificantly more expensive, than devices of the prior art, the conditions of flow in the bypass valve are taken into consideration better with respect to the pressure equalization so that complete pressure equalization is obtained in all positions of the valve element. As a result, the energy requirement of the electromagnet which moves the valve element is extremely slight.

The measure in accordance with the invention is particularly advantageous when the valve element is developed with an at least approximately conical region thereof which is movable into a valve seat.

The pressure equalization takes place very precisely if the valve seat has a conical widening towards its outlet side. Aside from this, it has been found that a bypass valve having such a valve seat has less tendency to become dirty than the previously known bypass valves.

It is particularly favorable if there is an angle of 5 to 25 degrees, open towards the upstream side, between said conical widening and the conical region of the valve element in the closed position of the valve element.

The device is structurally favorable if the valve seat is formed by a step in the housing into which the pressure-equalization connection debouches and which is closed off from the gap and the downstream side by a flange-like structural part which forms the valve seat and has at least one pressure-inlet hole towards the gap. This embodiment also makes it possible to change the valve seat independently of the development of the housing and adapt it to the specific circumstances.

The pressure-equalization connection need not necessarily lead through the housing of the device. In accordance with another embodiment of the invention, it can also pass through the valve element to the gap.

The invention permits of numerous possible embodiments.

DETAILED DESCRIPTION OF THE PREFERRED EMBODIMENT

Figure 1:
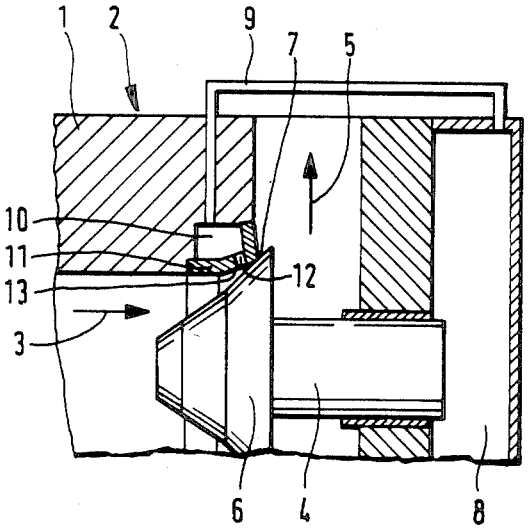
FIG. 1 shows a first embodiment of the invention in schematic form in cross-sectional view.

The drawing shows a part of a housing 1 of a bypass valve 2 into which valve air enters in the direction indicated by an arrow 3, the air leaving the bypass valve 2 behind a valve element 4 in the direction indicated by an arrow 5. A conical region 6 of the valve element 4 extends into a valve seat 7.

An electromagnet, not shown in the drawing, is employed for moving the valve element to the right as seen in the drawing, so that the bypass valve 2 is opened to a greater or lesser extent. For the pressure-equalization of the valve element there is provided a back-pressure chamber 8 from which a pressure-equalization connection 9 leads to a step 10 in the housing, which step is covered by a flange-like structural part 11. This part 11 forms the actual valve seat 7. Its inner wall surface forms a conical widening 13 which increases in diameter towards the outlet side of the bypass valve 2. Between the conical widening 13, which faces the conical region 6 of the valve element 4, and the conical region 6, an angle of 5 to 25 degrees is formed. A pressure-inlet hole 12 or several such holes connect the step 10 in the housing with the gap between the conical region 6 and the outer wall surface of the flange-like structural part 11. As a result, the tapping off of the pressure from the pressure-equalization chamber 8 takes place as close as possible to the narrowest part of the gap.

Figure 2:
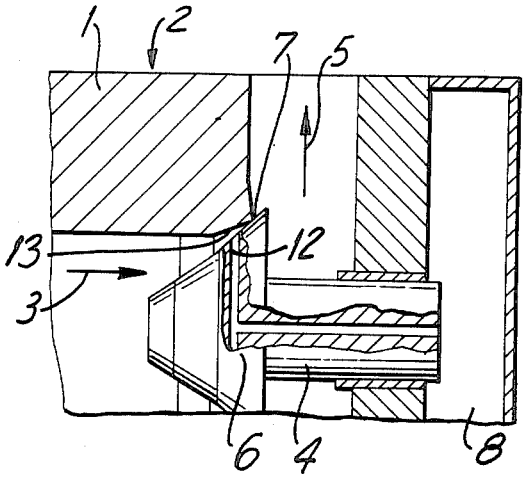
FIG. 2 is a partial sectional view of an alternative embodiment of the invention.

FIG. 2 shows an alternative embodiment of the invention wherein the valve element of FIG. 1 has been modified with a passage communicating between the back-pressure chamber 8 and the upstream side of the valve element in lieu of the connection of FIG. 1.

We claim:

1. A device for regulating the idling rpm of an internal combustion engine having an intake pipe with a throttle valve therein, which throttle valve is actuatable as desired, there being a bypass disposed around the throttle valve, and wherein the bypass has a bypass valve which is controlable as a function of operating parameters of the internal combustion engine, said bypass valve having a valve element, said valve element being displaceable relative to a valve seat by an electromagnet in order to regulate the size of a passage cross section, there being a back-pressure chamber, the valve element having a pressure-equalization surface located in the back-pressure chamber, wherein a pressure-equalization connection from the back-pressure chamber leads to the upstream side of the valve element, and wherein said pressure-equalization connection commences at a narrowest part of a gap between the valve element and the valve seat; and wherein said valve seat includes a housing and a flange-like structural part and a step in the housing, said pressure-equalization connection bebouching into said step, the step being closed off from the gap and the downstream side of said bypass valve by said flange-like structural part, said structural part forming the valve seat and having at least one pressure-inlet hole towards the gap.

2. A device for regulating the idling rpm of an internal combustion engine having an intake pipe with a throttle valve therein, which throttle valve is actuatable as desired, there being a bypass disposed around the throttle valve, and wherein the bypass has a bypass valve which is controllable as a function of operating parameters of the internal combustion engine, said bypass valve having a valve element, said valve element being displaceable relative to a valve seat by an electromagnet in order to regulate the size of a passage cross section, the improvement wherein said device further comprises a back-pressure chamber, the valve element having a pressure-equalization surface located in the back-pressure chamber, wherein a pressure-equalization connection from the back-pressure chamber leads to the upstream side of the valve element, said back-pressure chamber communicating solely with the upstream side of said valve element via said pressure-equalization connection to isolate a back-pressure of said chamber from a pressure of said intake pipe downstream of said valve element, and wherein said pressure-equalization connection commences at a narrowest part of a gap between the valve element and the valve seat; and wherein said valve element is formed with an approximately conical region configured for movement into the valve seat, and said valve seat has a conical widening towards an outlet side.

3. The device according to claim 2, wherein between the conical widening and the conical region of said valve element there is present, in a closed position of said valve element, an angle of 5 to 25 degrees opening towards the upstream side of said bypass valve.

4. The device according to claim 2, wherein said pressure-equalization connection extends through the valve element up to the gap.

* * * * *